US008173585B2

(12) United States Patent
Cobb et al.

(10) Patent No.: US 8,173,585 B2
(45) Date of Patent: May 8, 2012

(54) ACIDIC HARD SURFACE CLEANING COMPOSITIONS

(75) Inventors: Victoria Heather Cobb, Hull (GB); James Young, Hull (GB)

(73) Assignee: Reckitt Benckiser (UK) Limited, Slough (GB)

( * ) Notice: Subject to any disclaimer, the term of this patent is extended or adjusted under 35 U.S.C. 154(b) by 0 days.

(21) Appl. No.: 12/517,865

(22) PCT Filed: Dec. 6, 2007

(86) PCT No.: PCT/GB2007/004666

§ 371 (c)(1),
(2), (4) Date: Jan. 21, 2011

(87) PCT Pub. No.: WO2008/068488

PCT Pub. Date: Jun. 12, 2008

(65) Prior Publication Data

US 2011/0112006 A1 May 12, 2011

Related U.S. Application Data

(60) Provisional application No. 60/869,169, filed on Dec. 8, 2006.

(51) Int. Cl.

| | |
|---|---|
| ***C11D 1/66*** | (2006.01) |
| ***C11D 3/20*** | (2006.01) |
| ***C11D 3/43*** | (2006.01) |

(52) U.S. Cl. ..... 510/191; 510/237; 510/238; 510/421; 510/422; 510/423; 510/426; 510/427; 510/433; 510/434; 510/477; 510/488; 510/504; 510/505; 510/506

(58) Field of Classification Search ..... 510/237, 510/238, 421, 422, 423, 426, 527, 433, 434, 510/477, 488, 504, 505, 506, 191; 134/42
See application file for complete search history.

(56) References Cited

U.S. PATENT DOCUMENTS

| | | | | |
|---|---|---|---|---|
| 5,691,288 | A | 11/1997 | Dhillon | |
| 2001/0008877 | A1 * | 7/2001 | Hartmann et al. | 510/171 |
| 2003/0109395 | A1 | 6/2003 | Neumiller | |
| 2009/0197786 | A1 * | 8/2009 | Perry et al. | 510/191 |

FOREIGN PATENT DOCUMENTS

| | | | |
|---|---|---|---|
| EP | 0351185 | A | 1/1990 |
| WO | 9418300 | A | 8/1994 |
| WO | 9743369 | A | 11/1997 |
| WO | 0204589 | A | 1/2002 |
| WO | 2005078057 | A | 8/2005 |

OTHER PUBLICATIONS

Material Safety Data Sheet—Isopar E (Oct. 2008).*
Material Safety Data Sheet—Isopar H (Oct. 2008).*

* cited by examiner

*Primary Examiner* — Gregory Delcotto
(74) *Attorney, Agent, or Firm* — Norris McLaughlin & Marcus PA

(57) ABSTRACT

The present invention relates to liquid acidic hard surface cleaning composition which are effective against common stains encountered on hard surfaces, methods for cleaning such hard surfaces as well as methods for the manufacture of said liquid acidic hard surface cleaning compositions.

5 Claims, 1 Drawing Sheet

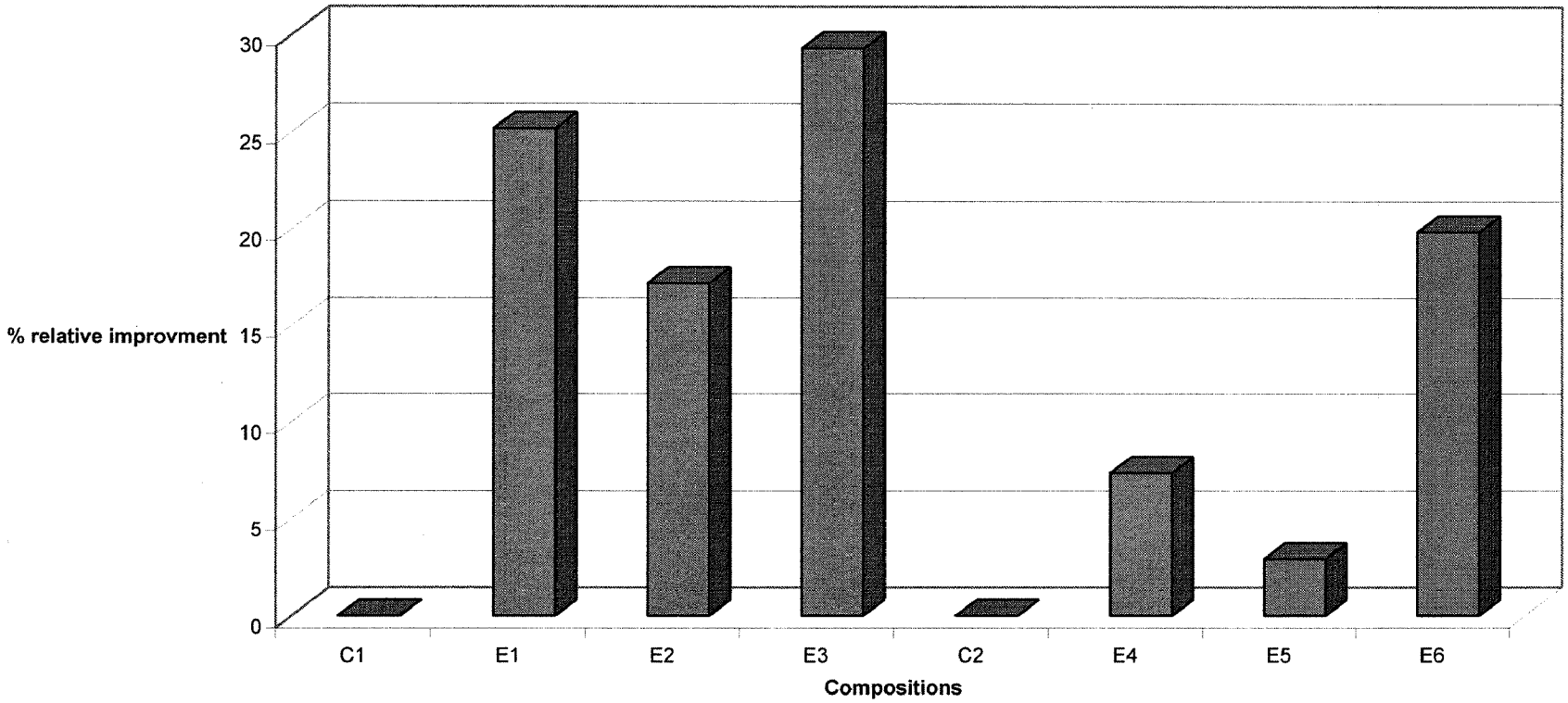
% relative improvment
30
25
20
15
10
5
0
C1
E1
E2
E3
C2
E4
E5
E6
Compositions

ACIDIC HARD SURFACE CLEANING COMPOSITIONS

This is an application filed under 35 USC 371 of PCT/GB2007/004666.

The present invention relates to aqueous acidic hard surface cleaning compositions.

Hard surface cleaning compositions are commercially important products and enjoy a wide field of use, and are known in assisting in the removal of dirt and grime from surfaces, especially those characterized as useful for cleaning "hard surfaces". Hard surfaces include those which are frequently encountered in lavatories, for example lavatory fixtures such as toilets, shower stalls, bathtubs, bidets, sinks, etc., as well as countertops, walls, floors, etc. In such lavatory environments two types of commonly encountered stains in lavatories include "hard water" stains, "soap scum" stains as well as "rust stains". Such hard surfaces, and such stains, may also be found in different environments as well, including kitchens, hospitals, etc. Hard water stains are mineral stains caused by the deposition of salts, such as calcium or magnesium salts which are frequently present in hard water which is commonly encountered. Soap scum stains are residues of fatty acid soaps, such as soaps which are based on alkaline salts of low fatty acids. These fatty acids are known to precipitate in hard water due to the presence of metal salts therein leaving an undesirable residue upon such surfaces. Still further stains, typically referred to as greasy stains, are surface residues which generally comprise hydrophobic materials often with further materials which leave unsightly residues on surfaces. Rust stains are typically formed by the presence of undesired amounts of iron oxides in water which may form unsightly deposits on hard surfaces.

Many hard surface cleaning compositions are already known to the art. For example, EP-A-330379 describes the use of cleaning compositions which contain at least one ether alcohol, water and a hydrocarbon in a single phase, respectively in the percent weight ratios 90-50:2-36:25-0.9. The composition is said to be suitable for removing oil adherent from surfaces e.g. rock cuttings produced during drilling operations for oil. The compositions are made by simply mixing the chemicals, hand shaking, and then allowing the mixture to separate into three phases. The middle phase was the cleaning composition, and was extracted and used for cleaning tests. This middle phase contained the ether alcohol in major proportion, and lesser amounts of water and hydrocarbon.

A disadvantage of this system is the large amount of alcohol ether present in the cleaning composition. The use of large amounts of many alcohol ethers is now restrained by legislation relating to VOCs (volatile organic components).

Co-pending applications PCT/GB2005/000449 and PCT/GB2005/000445, disclose a cleaning compositions comprising water, amphiphile and hydrocarbon which show self-induced motility driven by the Marangoni effect. These however require a large proportion of an amphiphile constituent in order to function.

While the prior art provides a variety of compositions which provide effective cleaning of one or more, typically all of the foregoing classes of stains, there is still an urgent need in the art to provide improved hard surface cleaning compositions which are effective in the treatment of many types of stains typically encountered on hard surfaces, particularly in a home or commercial environment, especially in or around kitchens, bathrooms where cleanliness is of especial importance. It is to such needs that the compositions of the present invention are particularly directed.

Broadly, the present invention relates to liquid acidic hard surface cleaning compositions which are effective against common stains encountered on hard surfaces, methods for cleaning such hard surfaces as well as methods for the manufacture of said liquid acidic hard surface cleaning compositions.

In accordance with a first aspect of the invention there is provided an acidic hard surface cleaning composition which includes:

a surfactant system which includes one or more of anionic, cationic, nonionic, amphoteric or zwitterionic surfactants in amounts of at least 0.01% wt, preferably in amounts of between in excess of 1% wt. to 30% wt., with the proviso that if a cationic surfactant is present, is it present in an amount of in excess of 1% wt, more preferably in an amount of at least 1.1% wt.;

a volatile hydrocarbon having a volatility greater than that of water, and preferably wherein the volatile hydrocarbon has a vapor pressure of 0.2 mmHg or more at 20° C. in amount effective to impart motility when the composition is applied as a film or laminar layer to a hard surface at normal atmospheric conditions ('sea level') and at ambient temperature (approx. 20° C.);

an acid constituent which includes one or more acids, including one or more organic or inorganic acids in an amount effective to impart an acidic pH to the composition;

optionally, when the compositions of the invention comprise more than 1% wt. of a cationic surfactant, and/or when the compositions of the invention comprise one or more anionic, amphoteric or zwitterionic surfactants in amount of at least 0.01% wt., the compositions of the invention may include an amphiphilic solvent constituent;

further optionally, one or more further constituents including coloring agents, fragrances and fragrance solubilizers, viscosity modifying agents including one or more thickeners, pH adjusting agents and pH buffers including organic and inorganic salts, optical brighteners, organic solvents, opacifying agents, hydrotropes, abrasives, and preservatives, as well as other optional constituents known to the art;

and water in an amount of at least 80% wt., preferably in an amount of at least 85% wt. based on the total weight of the composition of which it forms a part, wherein the composition exhibits self-induced movement when the composition is applied as a film or laminar layer onto a hard surface.

In a second aspect of the invention there is provided a methods for cleaning hard surfaces comprising the step of providing a cleaning effective amount of a hard surface cleaning composition according to the first aspect of the invention.

According to a third aspect of the invention, there is provided a methods for the manufacture of said liquid acidic hard surface cleaning compositions according to the first aspect of the invention.

It has been surprisingly discovered that in contrast to the teachings of PCT/GB2005/000449 and PCT/GB2005/000445, than an amphiphile constituent is not always required and further that compositions comprising elevated levels of one or more surfactants may be produced while still exhibiting a motility when the composition is applied as a film or laminar layer to a hard surface. Such a finding was contrary to expectations which would have suggested that both the amphiphile constituent, e.g., the alkylpyrrolidone compounds suggested by the art was essential and/or, that only limited amounts of anionic, nonioinic, zwitterionic or amphoteric surfactants could be present, namely in amounts of up to 1% wt., which suggested that increased surfactant levels would unduly solubilize the remaining constituents such that the self-induced motion would not occur. Such was discovered to be untrue by the present inventors.

The compositions of the present invention comprise a surfactant system which includes one or more of anionic, cationic, nonionic, amphoteric or zwitterionic surfactants in amounts of at least 0.1% wt, preferably in amounts of from in excess of 1% to about 30% wt., with the proviso that if a cationic surfactant is present is it desirably present in an amount of in excess of 1% wt, more preferably in an amount of at least 1.1% wt.

Exemplary of anionic surfactants which may be present include alcohol sulfates and sulfonates, alcohol phosphates and phosphonates, alkyl ester sulfates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, alkyl ether sulfates, alpha-olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates or mixtures thereof. These anionic surfactants may be provided as salts with one or more organic counterions, e.g., ammonium, or inorganic counteraions, especially as salts of one or more alkaline earth or alkaline earth metals, e.g., sodium.

Further examples of anionic surfactants include water soluble salts or acids of the formula $(ROSO_3)_xM$ or $(RSO_3)_xM$ wherein R is preferably a $C_6$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a mono-, di- or tri-valent cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like) and x is an integer, preferably 1 to 3, most preferably 1. Materials sold under the Hostapur and Biosoft trademarks are examples of such anionic surfactants.

Still further examples of anionic surfactants include alkyl-diphenyl-ethersulphonates and alkyl-carboxylates.

Also useful as anionic surfactants are diphenyl disulfonates, and salt forms thereof, such as a sodium salt of diphenyl disulfonate commercially available as Dowfax® 3B2. Such diphenyl disulfonates are included in certain preferred embodiments of the invention in that they provide not only a useful cleaning benefit but concurrently also provide a useful degree of hydrotropic functionality.

Other anionic surfactants can include salts (including, for example, sodium, potassium, ammonium, and substituted ammonium salts such as mono-, di- and triethanolamine salts) of soap, $C_6$-$C_{20}$ linear alkylbenzenesulfonates, $C_6$-$C_{22}$ primary or secondary alkanesulfonates, $C_6$-$C_{24}$ olefinsulfonates, sulfonated polycarboxylic acids prepared by sulfonation of the pyrolyzed product of alkaline earth metal citrates, $C_6$-$C_{24}$ alkylpolyglycolethersulfates, alkyl ester sulfates such as $C_{14-16}$ methyl ester sulfates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside, branched primary alkyl sulfates, alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Examples of the foregoing anionic surfactants are available under the following tradenames: Rhodapon®, Stepanol®, Hostapur®, Surfine®, Sandopan®, Neodox®, Biosoft®, and Avanel®.

An anionic surfactant compound which may be particularly useful in the inventive compositions when the compositions are at a pH of 2 or less are one or more anionic surfactants based on alphasulphoesters including one or more salts thereof. Such particularly preferred anionic surfactants may be represented by the following general structures:

(A)

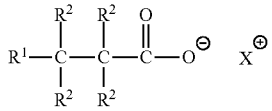

(B)

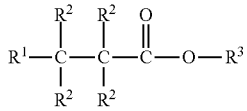

wherein, in each of the foregoing:

$R^1$ represents a $C_6$-$C_{22}$ alkyl or alkenyl group;

each of $R^2$ is either hydrogen, or if not hydrogen is a $SO_3^-$ having associated with it a cation, $X^+$, which renders the compound water soluble or water dispersible, with X preferably being an alkali metal or alkaline earth metal especially sodium or potassium, especially sodium, with the proviso that at least one $R^2$, preferably at least two $R^2$ is a $(SO_3^-)$ having an associated cation $X^+$, and, $R^3$ represents a $C_1$-$C_6$, preferably $C_1$-$C_4$ lower alkyl or alkenyl group, especially methyl.

According to certain preferred embodiments, anionic surfactants are however expressly excluded from the compositions of the present invention.

One class of exemplary useful nonionic surfactants are polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

Further useful nonionic surfactants include the condensation products of aliphatic alcohols with from about 1 to about 60 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5 (also available as Teric G9A5), which is described in product literature from Sasol as a $C_{8-10}$ having an average molecular weight of 356, an ethylene oxide content of about 4.85 moles (about 60 wt. %), and an HLB of about 12; Alfonic® 810-2, which is described in product literature from Sasol as a $C_{8-10}$ having an average molecular weight of 242, an ethylene oxide content of about 2.1 moles (about 40 wt. %), and an HLB of about 12; and Alfonic® 610-3.5, which is described in product literature from Sasol as having an average molecular weight of 276, an ethylene oxide content of about 3.1 moles (about 50 wt. %), and an HLB of 10. Product literature from Sasol also identifies that the numbers in the alcohol ethoxylate name designate the carbon chain length (numbers before the hyphen) and the average moles of ethylene oxide (numbers after the hyphen) in the product.

Further exemplary useful nonionic surfactants include alcohol ethoxylates available from Shell Chemical Company which are described as $C_9$-$C_{11}$ ethoxylated alcohols and marketed under the Neodol® tradename. The Neodol® 91 series non-ionic surfactants of interest include Neodol 91-2.5, Neodol 91-6, and Neodol 91-8. Neodol 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Still further examples of ethoxylated alcohols include the Rhodasurf® DA series non-ionic surfactants available from Rhodia which are described to be branched isodecyl alcohol ethoxylates. Rhodasurf DA-530 has been described as having 4 moles of ethoxylation and an HLB of 10.5; Rhodasurf DA-630 has been described as having 6 moles of ethoxylation with an HLB of 12.5; and Rhodasurf DA-639 is a 90% solution of DA-630.

Further examples of useful nonionic surfactants include alcohol ethoxylates including C10 oxo-alcohol ethoxylates available from BASF under the Lutensol ON tradename. They are available in grades containing from about 3 to about 11 moles of ethylene oxide (available under the names Lutensol ON 30; Lutensol ON 50; Lutensol ON 60; Lutensol ON 65; Lutensol ON 66; Lutensol ON 70; Lutensol ON 80; and Lutensol ON 110).

Yet further examples of ethoxylated alcohols include those from Tomah Products (Milton, Wis.) under the Tomadol tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear C9/C10/C11 and n is 2.5, 6, or 8; 1-3; 1-5; 1-7; 1-73B; 1-9;—where R is linear C11 and n is 3, 5, 7 or 9; 23-1; 23-3; 23-5; 23-6.5—where R is linear C12/C13 and n is 1, 3, 5, or 6.5; 25-3; 25-7; 25-9; 25-12—where R is linear C12/C13 C14/C15 and n is 3, 7, 9, or 12; and 45-7; 45-13—where R is linear C14/C15 and n is 7 or 13.

Other examples of useful nonionic surfactants include those having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename. available from Clariant, Charlotte, N.C., include the 26-L series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N. From product literature, the single number following the "L" corresponds to the average degree of ethoxylation (numbers between 1 and 5) and the two digit number following the letter "L" corresponds to the cloud point in ° C. of a 1.0 wt. % solution in water.

A specific class of useful nonionic surfactants include are monobranched alkoxylated C10-fatty alcohols and/or C11-fatty alcohols; these are jointly referred to as C10/C11-fatty alcohols. These materials are nonionic surfactants are monobranched and may have various degrees of alkoxylation, and are typically ethoxylated with between about 3 and 14 moles of ethylene oxide, typically 4, 5, 6, 7, 8, 9, 10 or 14 moles ethylene oxide. Such nonionic surfactants are presently commercially available under the Lutensol® (ex. BASF AG) and are available in a variety of grades e.g., Lutensol® XL 40 recited by its supplier to be a C10-Guerbet alcohol which is approximately 4 moles of ethoxylation, Lutensol® XL 50 recited by its supplier to be a C10-Guerbet alcohol which is approximately 5 moles of ethoxylation, Lutensol® XL 60 recited by its supplier to be a C10-Guerbet alcohol which is approximately 6 moles of ethoxylation, Lutensol® XL 70 recited by its supplier to be a C10-Guerbet alcohol which is approximately 7 moles of ethoxylation, Lutensol® XL 40 recited by its supplier to be a C10-Guerbet alcohol which is approximately 4 moles of ethoxylation, Lutensol® XL 79 recited by its supplier to be a C10-Guerbet alcohol which is approximately 7 moles of ethoxylation, Lutensol® XL 80 recited by its supplier to be a C10-Guerbet alcohol which is approximately 8 moles of ethoxylation, Lutensol® XL 89 recited by its supplier to be a C10-Guerbet alcohol which is approximately 8 moles of ethoxylation, Lutensol® XL 90 recited by its supplier to be a C10-Guerbet alcohol which is approximately 9 moles of ethoxylation, Lutensol® XL 99 recited by its supplier to be a C10-Guerbet alcohol which is approximately 9 moles of ethoxylation, Lutensol® XL 100 recited by its supplier to be a C10-Guerbet alcohol which is approximately 10 moles of ethoxylation, Lutensol® XL 140 recited by its supplier to be a C10-Guerbet alcohol which is approximately 14 moles of ethoxylation, all available from BASF AG. Alternately or additionally, nonionic surfactant based on monobranched alkoxylated C10-fatty alcohols marketed under the Lutensol® XP series of surfactants, also ex. BASF AG, may also be used. While the foregoing materials are ethoxylated, it is to be understood that other alkoxylated, e.g., propoxylated, butoxylated, as well as mixed ethoxylated and propoxylated branched nonionic alkyl polyethylene glycol ether may also be used.

It is contemplated by the inventors that similar nonionic surfactants based on monobranched alkoxylated C11-fatty alcohols may be used to substitute part of, or all of the nonionic surfactant based on monobranched alkoxylated C10-fatty alcohols. These include for example, the Genapol® UD series described as tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO (ex. Clariant).

The nonionic surfactant based on monobranched alkoxylated C10/C11-fatty alcohols (and/or C11-fatty alcohols) is often advantageously present in the hard surface cleaning compositions; wherein they are advantageously present in amounts of from 0.01-5% wt., preferably in amount of from 0.5-3% wt., yet more preferably from 1-3% wt. based on the total weight of the hard surface cleaning composition of which it forms a part.

A further class of nonionic surfactants which are contemplated to be useful include those based on alkoxy block copolymers, and in particular, compounds based on ethoxy/propoxy block copolymers. Polymeric alkylene oxide block copolymers include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO)_y(EO)_z\text{—}H \quad (A)$$

where

EO represents ethylene oxide,

PO represents propylene oxide, y equals at least 15, $(EP)_{x+y}$ equals 20 to 50% of the total weight of said compounds, and, the total molecular weight is preferably in the range of about 2000 to 15,000. These surfactants are available under the PLURONIC tradename from BASF or Emulgen from Kao.

Another group of nonionic surfactants appropriate for use in the new compositions can be represented by the formula (B):

$$R\text{-}(EO,PO)_a(EO,PO)_b\text{—}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO\text{—}(BO)_n(EO)_x\text{—}H \quad (C)$$

wherein R is an alkyl group containing I to 20 carbon atoms, n is about 5-15 and x is about 5-15.

Also useful as the nonionic block copolymer surfactants, which also include polymeric butoxy groups, are those which may be represented by the following formula (D):

$$HO\text{-}(EO)_x(BO)_n(EO)_y\text{—}H \quad (D)$$

wherein n is about 5-15, preferably about 15, x is about 5-15, preferably about 15, and y is about 5-15, preferably about 15.

Still further useful nonionic block copolymer surfactants include ethoxylated derivatives of propoxylated ethylene diamine, which may be represented by the following formula:

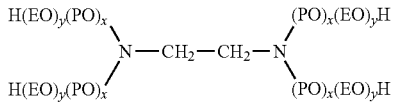

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Surfactants based on amine oxides are also contemplated to be useful in the cosurfactant constituent in the present inventive compositions. Exemplary amine oxides include:

alkyl di($C_1$-$C_7$) amine oxides in which the alkyl group has about 10-20, and preferably 12-16 carbon atoms, and can be straight or branched chain, saturated or unsaturated. Examples of such compounds include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

alkyl di(hydroxy $C_1$-$C_7$) amine oxides in which the alkyl group has about 10-20, and preferably 12-16 carbon atoms, and can be straight or branched chain, saturated or unsaturated. Examples of such compounds include bis(2-hydroxyethyl) cocoamine oxide, bis(2-hydroxyethyl) tallowamine oxide; and bis(2-hydroxyethyl) stearylamine oxide;

alkylamidopropyl di($C_1$-$C_7$) amine oxides in which the alkyl group has about 10-20, and preferably 12-16 carbon atoms, and can be straight or branched chain, saturated or unsaturated. Examples of such compounds include cocoamidopropyl dimethyl amine oxide and tallowamidopropyl dimethyl amine oxide; and alkylmorpholine oxides in which the alkyl group has about 10-20, and preferably 12-16 carbon atoms, and can be straight or branched chain, saturated or unsaturated.

The compositions may include one or more cationic surfactants including one or more of those described for example in *McCutcheon's Functional Materials*, Vol. 2, 1998; *Kirk-Othmer, Encyclopedia of Chemical Technology,* 4th Ed., Vol. 23, pp. 481-541 (1997), the contents of which are herein incorporated by reference.

Examples of preferred cationic surfactant compositions are those which provide a germicidal effect to the compositions, and especially preferred are quaternary ammonium compounds and salts thereof, which may be characterized by the general structural formula:

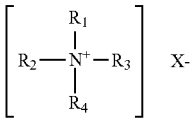

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxy-alkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act also provide a germicidal effect include those which have the structural formula:

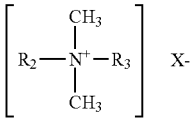

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks, which are more fully described in, for example, *McCutcheon's Functional Materials* (Vol. 2), North American Edition, 1998, as well as the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in *McCutcheon's* as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MIX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (50% solution); HYAMINE® 3500 (50% actives), described as alkyl dimethyl benzyl ammonium chloride (also available as 80% active (HYAMINE® 3500-80)); and HYMAINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% acive); BTC® 776 is described to be myrisalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.) Polymeric quaternary ammonium salts based on these monomeric structures are also considered desirable for the present invention. One example is POLYQUAT®, described as being a 2-butenyldimethyl ammonium chloride polymer.

When present in the absence of anionic, nonionic, zwitterionic or amphoteric surfactants, the cationic surfactant is desirably present in an amount of at least just slightly in excess of 1% wt., preferably in an amount of at least 1.05% wt., however when one or more anionic, nonionic, zwitterionic or amphoteric surfactants are simultaneously present, and especially when such one or more surfactants are present in an amount of at least 1% wt., the cationic surfactant may omitted, but if present is present in amounts in excess of 1% wt.

By way of non-limiting example exemplary amphoteric surfactants which are contemplated to be useful in the cosurfactant constituent include one or more water-soluble betaine surfactants which may be represented by the general formula:

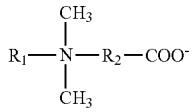

wherein $R_1$ is an alkyl group containing from 8 to 18 carbon atoms, or the amido radical which may be represented by the following general formula:

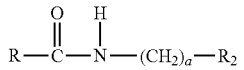

wherein R is an alkyl group having from 8 to 18 carbon atoms, a is an integer having a value of from 1 to 4 inclusive, and $R_2$ is a $C_1$-$C_4$ alkylene group. Examples of such water-soluble betaine surfactants include dodecyl dimethyl betaine, as well as cocoamidopropylbetaine.

A surfactant which is desirably present according to certain preferred embodiments of the invention is an alkylpolyglucoside which is to be understood as including alkylmonoglucosides and alkylpolyglucosides surfactant based on a polysaccharide, which are preferably one or more alkyl polyglucosides. These materials may also be referred to as alkyl monoglucosides and alkylpolyglucosides. Suitable alkyl polyglucosides are known nonionic surfactants which are alkaline and electrolyte stable. Such include alkyl glucosides, alkyl polyglucosides and mixtures thereof. Alkyl glucosides and alkyl polyglucosides can be broadly defined as condensation articles of long chain alcohols, e.g., $C_8$-$C_{30}$ alcohols, with sugars or starches or sugar or starch polymers i.e., glucosides or polyglucosides. These compounds can be represented by the formula $(S)_n$—O—R wherein S is a sugar moiety such as glucose, fructose, mannose, and galactose; n is an integer of from about 1 to about 1000, and R is a $C_{8-30}$ alkyl group. Examples of long chain alcohols from which the alkyl group can be derived include decyl alcohol, cetyl alcohol, stearyl alcohol, lauryl alcohol, myristyl alcohol, oleyl alcohol and the like.

Alkyl mono- and polyglucosides are prepared generally by reacting a monosaccharide, or a compound hydrolyzable to a monosaccharide with an alcohol such as a fatty alcohol in an acid medium. Various glucoside and polyglucoside compounds including alkoxylated glucosides and processes for making them are disclosed in U.S. Pat. No. 2,974,134; U.S. Pat. No. 3,219,656; U.S. Pat. No. 3,598,865; U.S. Pat. No. 3,640,998; U.S. Pat. No. 3,707,535; U.S. Pat. No. 3,772,269; U.S. Pat. No. 3,839,318; U.S. Pat. No. 3,974,138; U.S. Pat. No. 4,223,129; and U.S. Pat. No. 4,528,106.

Exemplary useful alkyl glucoside surfactants suitable for use in the practice of this invention may be represented by formula I below:

$$RO—(R_1O)_y\text{-}(G)_xZ_b \qquad \text{I}$$

wherein:

R is a monovalent organic radical containing from about 6 to about 30, preferably from about 8 to about 18 carbon atoms;

$R_1$ is a divalent hydrocarbon radical containing from about 2 to about 4 carbon atoms;

O is an oxygen atom;

y is a number which has an average value from about 0 to about 1 and is preferably 0;

G is a moiety derived from a reducing saccharide containing 5 or 6 carbon atoms; and x is a number having an average value from about 1 to 5 (preferably from 1.1 to 2);

Z is $O_2M^1$,

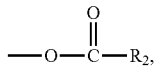

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, —$CH_2OH$, is oxidized to form a

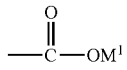

group);

b is a number of from 0 to 3x+1 preferably an average of from 0.5 to 2 per glycosal group;

p is 1 to 10, $M^1$ is $H^+$ or an organic or inorganic cation, such as, for example, an alkali metal, ammonium, monoethanolamine, or calcium.

As defined in Formula I above, R is generally the residue of a fatty alcohol having from about 8 to 30 and preferably 8 to 18 carbon atoms.

Further exemplary useful alkylpolyglucosides include those according to the formula II:

$$R_2O—(C_nH_{2n}O)_r—(Z)_x \qquad \text{II}$$

wherein:

$R_2$ is a hydrophobic group selected from alkyl groups, alkylphenyl groups, hydroxyalkylphenyl groups as well as mixtures thereof, wherein the alkyl groups may be straight chained or branched, and which contain from about 8 to about 18 carbon atoms, n has a value of 2-8, especially a value of 2 or 3; r is an integer from 0 to 10, but is preferably 0, Z is derived from glucose; and, x is a value from about 1 to 8, preferably from about 1.5 to 5.

Preferably the alkylpolyglucosides are nonionic fatty alkylpolyglucosides which contain a straight chain or branched chain $C_8$-$C_{15}$ alkyl group, and have an average of from about 1 to 5 glucose units per fatty alkylpolyglucoside molecule. More preferably, the nonionic fatty alkylpolyglucosides which contain straight chain or branched $C_8$-$C_{15}$ alkyl group, and have an average of from about 1 to about 2 glucose units per fatty alkylpolyglucoside molecule.

Examples of such alkylpolyglucosides as described above include, for example, APG™ 325 which is described as being a $C_9$-$C_{11}$ alkyl polyglucoside, also commonly referred to as D-glucopyranoside, (ex. Cognis). Further exemplary alkylpolyglucosides include Glucopon® 625 CS which is described as being a $C_{10}$-$C_{16}$ alkyl polyglucoside, also commonly referred to as a D-glucopyranoside, (ex. Cognis), lauryl polyglucoside available as APG™ 600 CS and 625 CS (ex. Cognis) as well as other materials sold under the Glucopon® tradename, e.g., Glucopon® 215, Glucopon® 225, Glucopon® 425, especially one or more of the alkyl polyglucosides demonstrated in one or more of the examples. It is believed that the alkylpolyglucoside surfactants sold under the Glucopon® tradename are synthesized at least in part on synthetically produced starting constituents and are colorless or only slightly colored, while those sold under the APG™ are synthesized at least in part on naturally occurring or sourced starting constituents and are more colored in appearance.

The surfactant system which includes one or more of anionic, cationic, nonionic, amphoteric or zwitterionic surfactants in amounts of at least 0.1% wt, preferably in amounts of from about 0.1-30% wt., preferably in an amount of from in excess of 1% wt., e.g., 1.05% wt. to 30% wt, with the proviso that if a cationic surfactant is present is it desirably present in an amount of in excess of 1% wt, more preferably in an amount of at least 1.1% wt, although a cationic surfactant may be omitted from the inventive compositions. Desirably the surfactant system necessarily includes one or more of anionic, cationic, nonionic, amphoteric or zwitterionic surfactants in an amount of at least 0.5% wt., preferably in excess of 1.0% wt, and in increasing orders of preference in amount in of at least 1.1% wt., 1.2% wt., 13% wt., 1.4% wt., 1.5% wt., 1.75% wt., 2% wt., 2.25% wt, 2.5% wt., 2.75% wt., and 3% wt. Also, desirably the surfactant system necessarily includes one or more of anionic, cationic, nonionic, amphoteric or zwitterionic surfactants in an amount in excess of 1.0% wt, and in increasing orders of preference in amount not in excess of 30% wt., 28% wt., 26% wt., 25% wt., 24% wt., 22% wt, and 20% wt.

The compositions of the invention require a volatile hydrocarbon. The volatile hydrocarbon is preferably insoluble in water, by which it is meant that its solubility in distilled water at 25° C. is 0.001% by weight of solution or less. The upper limit of the level of volatile hydrocarbon is preferably such that the level of volatile material released to the atmosphere during use of the composition is minimized. Mixtures of suitable volatile hydrocarbons may be employed in the compositions of the invention.

The volatile hydrocarbon is suitably a paraffinic, including isoparaffinic compounds. The volatile hydrocarbon may suitably be a hydrocarbon fragrance. Preferably it is a liquid under ambient conditions. Suitably the volatile hydrocarbon has from 5 to 15 carbon atoms, preferably from 8 to 12, more preferably from 9 to 11. When the volatile hydrocarbon is a mixture, as will often be the case, these definitions still apply, as mean values of the number of carbon atoms per molecule. By volatile it is meant that the volatile hydrocarbon has a vapour pressure of 0.2 mmHg or more at 20° C.

A monitor of the suitability of the volatile hydrocarbon when it is an isoparaffinic material, is the IBP (initial boiling point for distillation) as measured by ASTM D86. Suitably, the IBP in degree Celsius is 220 or less, preferably 200 or less, more preferably 180 or less.

Advantageously the compositions of the invention comprise from 0.1 to 10% by weight of one or more such volatile hydrocarbons, preferably from 0.3 to 7% by weight, more preferably from 0.5 to 3% by weight.

The compositions of the invention necessarily comprise an acid constituent, which necessarily includes one or more acids which are present in a sufficient amount in order to impart an acid pH to the compositions. The acids useful in the acid constituent may be one or more water soluble inorganic acids, mineral acids, or water soluble organic acids, with virtually all such known materials contemplated as being useful in the present inventive compositions. Exemplary inorganic acids include, e.g., phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate and sulfamic acid. Alkyl sulfonic acids, e.g., methane sulfonic acid may also be used as a co-acid component of the acid system. Strong inorganic acids such as hydrochloric acid, nitric acid and sulfuric acid may also be used, however are less preferred due to their strong acidic character; if present are present in only minor amounts. However, the use of water soluble acids as are preferred, including water soluble salts of organic acids. Exemplary organic acids are those which generally include at least one carbon atom, and include at least one carboxyl group (—COOH) in its structure. Exemplary useful water soluble organic acids which contain from 1 to about 6 carbon atoms, and at least one carboxyl group as noted. Exemplary useful organic acids include: linear aliphatic acids such as acetic acid, citric acid, propionic acid, butyric acid and valeric acid; dicarboxylic acids such as malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, α-hydroxybutyric acid, glyceric acid, tartronic acid, malic acid, tartaric acid and citric acid, as well as acid salts of these organic acids. The use of water soluble acids are preferred, including water soluble salts of organic acids.

In certain particularly preferred embodiments the acid constituent comprises the formic acid, sulfamic acid, citric acid, lactic acid and/or oxalic.

The acid constituent may be present in any amount effective in imparting an acidic pH to the inventive compositions. The acid constituent may be present in any effective amount, but desirably is not present in amounts totaling more than about 20% wt. based on the total weight of the compositions. It is to be understood that the nature of the acid or acids selected to form the acid constituent will influence the amount of acid required to obtain a desired final pH or pH range, and the precise amount of acid required for a specific composition can be readily obtained by a skilled artisan utilizing conventional techniques. Further, the amount of acid present in the composition, keeping in mind any optional ingredients that may be present, should be in an amount such that the pH of the composition is about 3 or less, and especially within the preferred pH ranges indicated previously. Generally however, the inclusion of the acid constituent in an amount of from about 1 to 15% wt., more preferably from about 3 to 12% wt. has yielded good results. Particularly preferred acids for use in the acid constituent and particularly preferred amounts thereof are also described with reference to one or more of the Examples.

As inventive compositions are necessarily acidic in nature and exhibit a pH of not more than 7, preferably not more than 6, yet more preferably not more than 5 and still more preferably not more than 4. Preferably the pH of the inventive compositions is between 0.001-4, more preferably is between 0.1-3.8. Certain particularly preferable pHs are demonstrated with reference to one or more of the Examples described hereinafter.

When the compositions of the invention comprise more than 1% wt. of a cationic surfactant, and/or when the compositions of the invention comprise one or more anionic, nonionic, amphoteric or zwitterionic surfactants in amount of at least 0.01% wt., the compositions of the invention may include an amphiphilic solvent constituent as well. Suitable amphiphilic solvents include substituted pyrrolidones, especially 1-alkyl-2-pyrrolidones. Preferably the alkyl group has, on average, 4 to 16 carbon atoms, more preferably 6 to 14 carbon atoms, and most preferably 8 to 12 carbon atoms. Preferably the alkyl group is linear. 1-octyl 2-pyrollidone is particularly suitable.

Quaternary N-alkylaldonamides may also be used as the amphiphilic solvent, for instance N-decylisosaccharinamide or N-octylribonamide and mixtures thereof.

Short alkyl chain alkyl glucosides, preferably with an alkyl chain length of $C_{10}$ or less, more preferably $C_8$ or less are also suitable amphiphilic solvents. Mono-, di-, tri, or tetra-glucosides or mixtures thereof are preferred.

Suitable amphiphilic solvents include glycol ethers and these are particularly preferred when present in the compositions of the invention.

Preferred glycol ethers for use as the amphiphilic solvent are compounds of the formula $R^1O(RO)_nH$ (I) in which R is a $C_1$-$C_8$ alkylene group (preferably $C_1$-$C_4$), n is at least 1 (preferably 2-4) and $R^1$ is a $C_1$-$C_8$ alkyl group (preferably $C_1$-$C_4$) or, especially, an optionally substituted aryl group). A preferred optionally substituted aryl group is an optionally substituted phenyl group. Substituents of an aryl or phenyl group include $C_1$-$C_4$ alkyl groups, $C_1$-$C_4$ alkoxy groups, $C_1$-$C_4$ haloalkyl groups, cyano groups, amido groups, amine groups, and halogen atoms. Preferred halogen atoms, including comprised within haloalkyl groups, include fluorine, chlorine and bromine atoms. There may suitably be 1-3 substituents. Preferably, however, an aryl or phenyl group is unsubstituted.

By way of non-limiting example, suitable glycol ethers not having an aromatic group include: ethoxypropoxypropanol; ethoxyethoxypropanol; propoxyethoxypropanol; propoxypropoxypropanol; butoxypropoxyethanol; butoxybutoxyethanol; butoxyethoxyethanol; ethoxypropanol; butoxyethanol; and, butyl diglycol ether.

By way of further non-limiting example, specific examples of suitable, and preferred, glycol ethers having an aromatic group include: ethylene glycol phenyl ether; phenoxypropanol; and phenoxypropoxypropanol. Of these, particularly preferred are 2-butoxyethanol, diethylene glycol monohexyl ether or phenoxyethanol, and mixtures thereof.

Short chain alcohols are suitable amphiphilic solvents for use in compositions of the invention, but are not preferred when used as the sole amphiphilic solvent present. Particularly suitable for use in combination with other amphiphilic solvents as described above are ethanol, propanol, isopropanol, n-butanol and t-butanol. Mixtures of these alcohols with other amphiphilic solvents may also be used in order to modify the phase boundaries relating to the compositions of the invention.

Especially preferred amphiphilic solvents are compounds which at no concentration are classified as VOCs as set out in the regulations of the US Government Environmental Protection Agency (EPA) for the envisaged application (preferably as cleaners in a household environment) at the priority date of this patent application. Other preferred amphiphilic solvents are compounds which are classified as VOCs by the EPA regulations but only at particular concentration levels; and which are present below such levels, in the composition of the invention.

Especially preferred glycol ethers are compounds having a vapor pressure of less than 0.1 mmHg at 20° C.

It is particularly preferred that the amphiphilic solvent is at least partially miscible with water. Preferably, the amphiphilic solvent is soluble in water at 25° C. at a level of 0.5% by weight of water or more (i.e. 0.5 grams of solvent per 100 grams of water), more preferably, 1.5% or more, even more preferably 3.5% or more. The solubility of the solvent in water is preferably less than 10% by weight of water, more preferably less than 6%. This is in order to optimise the mobility of the composition when exposed to the atmosphere on a surface.

A particularly preferred amphiphilic solvent is propylene glycol n-propyl ether, available as DOWANOL PnP (ex. DOW Co.)

If present, the amphiphilic solvent may be present in amounts of from 0.001% wt, to about 25% wt, preferably from 0.1 to 15% by weight, more preferably from 0.25 to 8% by weight, yet more preferably from 0.3 to 7% wt. Mixtures of amphiphilic solvents may be used as well, or alternately a single amphiphilic solvent may be present in the compositions.

In certain preferred embodiments, amphiphilic solvents are necessarily absent, e.g., when a cationic surfactant is present in an amount of up to 1% wt., or when a cationic surfactant is present in an amount of up to 1% wt. and up to 1% wt of other surfactants are also present.

In yet further preferred embodiments, one or more amphiphilic solvents may be present when the total amounts of surfactants present in the composition is in excess of 1% wt., or in excess of 2% wt.

The compositions of the invention necessarily exhibit some degree of motility, e.g., self-induced movement when the composition is applied as a film or laminar layer onto a hard surface at normal atmospheric conditions ('sea level') and at ambient temperature (approx. 20° C.). This effect is believed to be a "Marangoni-type" effect. By "Marangoni-type" we mean that the surface of the composition exhibited motility not induced by an external agent, such as an object applied to it; in other words it featured a self-induced motility Without wishing to be bound by theory, it is thought that this Marangoni-type effect may give rise to cleaning benefits exhibited by compositions of the invention. Compositions exhibiting the Marangoni-type effect may exhibit a tendency to "creep" into small spaces. Evaporation of a compound may lead to changes in surface tension and to surface motility, causing the composition to move, for example into and then out of a crack, drawing soils with it. Additionally it is hypothesized that compositions which exhibit the Marangoni-type effect may move into small interstices or may move between a surface and a soil deposit, "lifting" the latter which both removes the soils off the hard surface, and at the same time supplying a fresh quantity of the composition to the locus of the stain or soil and thus continue its removal from the hard surface. In this manner such a composition which exhibits such a Marangoni-type effect provides a dual function; (i) physical movement of the composition within its layer or lamina on a hard surface and particularly when in contact with a stain or soil, and (ii) replenishment of the composition in the locus of the stain or soil on a hard surface by a further quantity of the composition, which, due to its motility or motile behavior, "moves" or "flows" within the lamina or layer formed on a hard surface. This effect is believed to be possibly due to surface tension gradients, perhaps allied to crossing of phase boundaries, when volatile compounds evaporate in the composition evaporate from the hard surface on which it has been applied. Surprisingly however, when the composition is in a bulk form, e.g., in a larger three dimensional volume such as when contained in a container or in a vessel, and wherein the ratio of surface area to volume of the liquid composition is substantially reduced as compared to the ratio of surface area to volume of the liquid when the liquid composition is in the form of a lamina or layer formed on a hard surface, no visible "twitching" or movement, viz., "Marangoni-type" effect is observed in the bulk form.

The compositions of the invention may be in the form of a single phase composition or they may be in the form of compositions having two or more distinct phases when the compositions are allowed to rest for at least 12 hours in a vessel or other container. In certain and preferred embodiments the hard surface cleaning compositions exhibit at least two visibly distinct phases when allowed to rest in this manner.

The compositions of the invention may optionally include one or more further constituents including coloring agents, fragrances and fragrance solubilizers, viscosity modifying agents including one or more thickeners, pH adjusting agents and pH buffers including organic and inorganic salts, optical brighteners, organic solvents, opacifying agents, hydrotropes, abrasives, and preservatives, as well as other optional constituents known to the art.

By way of non-limiting example pH adjusting agents include phosphorus containing compounds, monovalent and polyvalent salts such as of silicates, carbonates, and borates, certain acids and bases, tartrates and certain acetates. Further exemplary pH adjusting agents include mineral acids, basic compositions, and organic acids, which are typically required in only minor amounts. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use as buffers such materials as aluminosilicates (zeolites), borates, aluminates and certain organic materials such as gluconates, succinates, maleates, and their alkali metal salts. When present, the pH adjusting agent, especially the pH buffers are present in an amount effective in order to maintain the pH of the inventive composition within a target pH range.

The inventive compositions may include one or more coloring agents which may be included to impart a desired color or tint to the compositions.

The compositions of the invention optionally but in certain cases desirably include a fragrance constituent. Fragrance raw materials may be divided into three main groups: (1) the essential oils and products isolated from these oils; (2) products of animal origin; and (3) synthetic chemicals.

The essential oils consist of complex mixtures of volatile liquid and solid chemicals found in various parts of plants. Mention may be made of oils found in flowers, e.g., jasmine, rose, mimosa, and orange blossom; flowers and leaves, e.g., lavender and rosemary; leaves and stems, e.g., geranium, patchouli, and petitgrain; barks, e.g., cinnamon; woods, e.g., sandalwood and rosewood; roots, e.g., angelica; rhizomes, e.g., ginger; fruits, e.g., orange, lemon, and bergamot; seeds, e.g., aniseed and nutmeg; and resinous exudations, e.g., myrrh. These essential oils consist of a complex mixture of chemicals, the major portion thereof being terpenes, including hydrocarbons of the formula (C5H8)n and their oxygenated derivatives. Hydrocarbons such as these give rise to a large number of oxygenated derivatives, e.g., alcohols and their esters, aldehydes and ketones. Some of the more important of these are geraniol, citronellol and terpineol, citral and citronellal, and camphor. Other constituents include aliphatic aldehydes and also aromatic compounds including phenols such as eugenol. In some instances, specific compounds may be isolated from the essential oils, usually by distillation in a commercially pure state, for example, geraniol and citronellal from citronella oil; citral from lemon-grass oil; eugenol from clove oil; linalool from rosewood oil; and safrole from sassafras oil. The natural isolates may also be chemically modified as in the case of citronellal to hydroxy citronellal, citral to ionone, eugenol to vanillin, linalool to linalyl acetate, and safrol to heliotropin.

Animal products used in perfumes include musk, ambergris, civet and castoreum, and are generally provided as alcoholic tinctures.

The synthetic chemicals include not only the synthetically made, also naturally occurring isolates mentioned above, but also include their derivatives and compounds unknown in nature, e.g., isoamylsalicylate, amylcinnamic aldehyde, cyclamen aldehyde, heliotropin, ionone, phenylethyl alcohol, terpineol, undecalactone, and gamma nonyl lactone.

Fragrance compositions as received from a supplier may be provided as an aqueous or organically solvated composition, and may include as a hydrotrope or emulsifier a surface-active agent, typically a surfactant, in minor amount. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

One or more coloring agents may also be used in the inventive compositions in order to impart a desired colored appearance or colored tint to the compositions. Known art water soluble or water dispersible pigments and dyes may be added in effective amounts.

The inventive compositions may optionally include one or more further organic solvents. Exemplary useful organic solvents which may be present in the inventive compositions include those which are at least partially water-miscible such as alcohols (e.g., low molecular weight alcohols, such as, for example, ethanol, propanol, isopropanol, and the like), glycols (such as, for example, ethylene glycol, propylene glycol, hexylene glycol, and the like), water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethylene glycol or propylene glycol (e.g. propylene glycol monomethyl ether acetate), and mixtures thereof. Glycol ethers having the general structure Ra—Rb—OH, wherein Ra is an alkoxy of 1 to 20 carbon atoms, or aryloxy of at least 6 carbon atoms, and Rb is an ether condensate of propylene glycol and/or ethylene glycol having from one to ten glycol monomer units. Mixtures of two or more specific organic solvents may be used, or alternately a single organic solvent may be provided as the organic solvent constituent.

When present, such optional organic solvents may be present in amounts of up to about 10% wt, preferably are present in amounts of from about 0.01-7.5% wt., still more preferably from about 0.1-5% wt. However, in certain particularly preferred embodiments, such optional organic solvents are excluded from the inventive compositions. Further, when present such optional organic solvents are to be considered as independent of the amphiphile solvent, if said amphiphile solvent is indeed present.

The inventive compositions may include a hydrotrope constituent comprising one or more compounds which exhibit a hydrotropic functionality in the inventive compositions. Exemplary hydrotropes include, inter alia, benzene sulfonates, naphthalene sulfonates, $C_1$-$C_{11}$ alkyl benzene sulfonates, naphthalene sulfonates, $C_5$-$C_{11}$ alkyl sulfonates, $C_6$-$C_{11}$ alkyl sulfates, alkyl diphenyloxide disulfonates, and phosphate ester hydrotropes. The hydrotropic compounds of the invention are often provided in a salt form with a suitable counterion, such as one or more alkali, or alkali earth metals, such as sodium or potassium, especially sodium. However, other water soluble cations such as ammonium, mono-, di- and tri-lower alkyl, i.e., $C_{1-4}$ alkanol ammonium groups can be used in the place of the alkali metal cations. Exemplary alkyl benzene sulfonates include, for example, isopropylbenzene sulfonates, xylene sulfonates, toluene sulfonates, cumene sulfonates, as well as mixtures thereof. Exemplary $C_5$-$C_{11}$ alkyl sulfonates include hexyl sulfonates, octyl sulfonates, and hexyl/octyl sulfonates, and mixtures thereof. Particularly useful hydrotrope compounds include benzene sulfonates, o-toluene sulfonates, m-toluene sulfonates, and p-toluene sulfonates; 2,3-xylene sulfonates, 2,4-xylene sulfonates, and 4,6-xylene sulfonates; cumene sulfonates, wherein such exemplary hydrotropes are generally in a salt form thereof, including sodium and potassium salt forms. When present the hydrotrope constituent may be present in any effective amounts, or they may be omitted. Advantageously, when present, the hydrotrope constituent comprises 0.001-1% wt. of the composition of which it forms a part.

A further optional constituent are one or more preservatives. Such preservatives are primarily included to reduce the growth of undesired microorganisms within the composition during storage prior to use. Exemplary useful preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. Further exemplary useful preservatives include those which are commercially including a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful and commercially available preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.).

Optionally one or more abrasives may be included in the inventive compositions. Exemplary abrasives include: oxides, e.g., calcined aluminum oxides and the like, carbonates, e.g., calcium carbonate and the like, quartzes, siliceous chalk, diatomaceous earth, colloidal silicon dioxide, alkali metasilicates, e.g., sodium metasilicate and the like, perlite, pumice, feldspar, calcium phosphate, organic abrasive materials based on comminuted or particulate polymers especially one or more of polyolefins, polyethylenes, polypropylenes, polyesters, polystyrenes, acetonitrile-butadiene-styrene resins, melamines, polycarbonates, phenolic resins, epoxies and polyurethanes, natural materials such as, for example, rice hulls, corn cobs, and the like, or talc and mixtures thereof. The particle size of the abrasive agent typically may range from about 1 μm to about 1000 μm, preferably between about 10 μm to about 200 μm, and more preferably between about 10 μm and about 100 μm. It is preferred to us those abrasive agents that will not scratch most hard surfaces. Such abrasive agents include calcium carbonate, siliceous chalk, diatomaceous earth, colloidal silicon dioxide, sodium metasilicate, talc, and organic abrasive materials. Calcium carbonate is preferred as being effective and available at a generally low cost. A single type of abrasive, or a mixture of two or more differing abrasive materials may be used.

Optionally the compositions may include an effective amount of at least one inorganic chloride salt, which are believed to improve the metal cleaning characteristics of the inventive compositions. The inorganic chloride salt is desirably present in an amount effective to provide improved cleaning of metal surfaces which are immersed or contacted with the inventive compositions. The inorganic chloride salt(s) used in the compositions of the present invention can be any water-soluble inorganic chloride salt or mixtures of such salts. For purposes of the present invention, "water-soluble" means having a solubility in water of at least 10 grams per hundred grams of water at 20° C. Examples of suitable salts include various alkali metal and/or alkaline earth metal chlorides including sodium chloride, calcium chloride, magnesium chloride and zinc chloride. Particularly preferred are sodium chloride and calcium chloride which have been surprisingly observed to provide excellent metal cleaning efficacy particularly of aged copper surfaces. The inorganic chloride salt(s) is present in the compositions of the present invention in an amount which will provide an improved cleaning of metal surfaces, particularly copper surfaces, compared to an identical composition which excludes the inorganic chloride salts(s). Preferably the inorganic chloride salt(s) are present in amounts of from about 0.00001 to about 2.5% by weight, desirably in amounts of 0.001 to about 2% by weight, yet more desirably from about 0.01 to about 1.5% by weight and most desirably from about 0.2 to about 1.5% weight. Particularly preferred inorganic chloride salt(s) and weight percentages thereof are described with reference to one or more of the Examples. In certain preferred embodiments the sole inorganic salts present are one or more inorganic chloride salts.

The inventive compositions may include a thickener constituent which may be added in any effective amount in order to increase the viscosity of the compositions. Exemplary thickeners useful in the thickener constituent include one or more of polysaccharide polymers selected from cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, naturally occurring polysaccharide polymers such as xanthan gum, guar gum, locust bean gum, tragacanth gum, or derivatives thereof, polycarboxylate polymers, polyacrylamides, clays, and mixtures thereof.

Examples of the cellulose derivatives include methyl cellulose ethyl cellulose, hydroxymethyl cellulose hydroxy ethyl cellulose, hydroxy propyl cellulose, carboxy methyl cellulose, carboxy methyl hydroxyethyl cellulose, hydroxypropyl cellulose, hydroxy propyl methyl cellulose, ethylhydroxymethyl cellulose and ethyl hydroxy ethyl cellulose.

Exemplary polycarboxylate polymers thickeners have a molecular weight from about 500,000 to about 4,000,000, preferably from about 1,000,000 to about 4,000,000, with, preferably, from about 0.5% to about 4% crosslinking. Preferred polycarboxylate polymers include polyacrylate polymers including those sold under trade names Carbopol®, Acrysol® ICS-1 and Sokalan®. The preferred polymers are polyacrylates. Other monomers besides acrylic acid can be used to form these polymers including such monomers as ethylene and propylene which act as diluents, and maleic anhydride which acts as a source of additional carboxylic groups.

Exemplary clay thickeners comprise, for example, colloid-forming clays, for example, such as smectite and attapulgite types of clay thickeners. The clay materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonite) and attapulgites (or polygorskites).

Preferred thickeners are those which provide a useful viscosity increasing benefit at the ultimate pH of the compositions, particularly thickeners which are useful at pH's of about 3 or less. While in certain embodiments the compositions may comprise a thicker constituent, it is generally preferred the compositions exhibit viscosities similar to that of water. The compositions preferably have a viscosity of not more than about 50 cps at room temperature, more preferably have a viscosity of not more than about 30 cps at room temperature.

As is noted above, the compositions according to the invention are largely aqueous in nature. Water is added to order to provide to 100% by weight of the compositions of the invention. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention. Preferably at least 80% wt, more preferably at least 85% wt of the compositions are water.

The compositions according to the invention are desirably provided as a ready to use product which may be directly applied to a hard surface. Hard surfaces which are to be particularly denoted are lavatory fixtures, lavatory appliances (toilets, bidets, shower stalls, bathtubs and bathing appliances), wall and flooring surfaces especially those which include refractory materials and the like. Further hard surfaces which are particularly denoted are those associated with dishwashers, kitchen environments and other environments associated with food preparation. Hard surfaces which are those associated with hospital environments, medical laboratories and medical treatment environments. Such hard surfaces described above are to be understood as being recited by way of illustration and not be way of limitation.

The inventive compositions may be packaged in any suitable container particularly flasks or bottles, including squeeze-type bottles, as well as bottles provided with a spray apparatus which is used to dispense the composition by spraying. The inventive compositions are readily pourable and readily pumpable cleaning compositions which features the benefits described above. Accordingly the inventive compositions are desirably provided as a ready to use product in a manually operated spray dispensing container, or may be supplied in aerosolized product wherein it is discharged from a pressurized aerosol container. Propellants which may be used are well known and conventional in the art and include, for example, a hydrocarbon, of from 1 to 10 carbon atoms, such as n-propane, n-butane, isobutane, n-pentane, isopentane, and mixtures thereof; dimethyl ether and blends thereof as well as individual or mixtures of chloro-, chlorofluoro- and/or fluorohydrocarbons- and/or hydrochlorofluorocarbons (HCFCs). Useful commercially available compositions include A-70 (Aerosol compositions with a vapor pressure of 70 psig available from companies such as Diversified and Aeropress) and Dymel® 152a (1,1-difluoroethane from DuPont). Compressed gases such as carbon dioxide, compressed air, nitrogen, and possibly dense or supercritical fluids may also be used. In such an application, the composition is dispensed by activating the release nozzle of said aerosol type container onto the area in need of treatment, and in accordance with a manner as above-described the area is treated (e.g., cleaned and/or sanitized and/or disinfected). If a propellant is used, if will generally be in an amount of from about 1% to about 50% of the aerosol formulation with preferred amounts being from about 2% to about 25%, more preferably from about 5% to about 15%. Generally speaking, the amount of a particular propellant employed should provide an internal pressure of from about 20 to about 150 psig at 70° F.

In a second aspect of the invention there is provided a methods for cleaning hard surfaces comprising the step of providing a cleaning effective amount of a hard surface cleaning composition according to the first aspect of the invention to a surface in need of cleaning, particularly a surface wherein undesired stains, e.g., limescale stains or soap scum stains are present.

The compositions according to the invention can also be suited for use in a consumer "spray and wipe" application as a cleaning composition. In such an application, the consumer generally applies an effective amount of the composition using the pump and within a few moments thereafter, wipes off the treated area with a rag, towel, or sponge, usually a disposable paper towel or sponge. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used. Optionally, after the composition has remained on the surface for a period of time, it could be rinsed or wiped from the surface.

It is contemplated that due to the acidic pH of the inventive compositions, in addition to good cleaning of a variety of stains commonly encountered on hard surfaces, the inventive compositions may also provide a disinfecting or sanitizing benefit of hard surfaces wherein the presence of undesired microorganisms are suspected such as gram positive or gram negative bacteria.

According to a third aspect of the invention, there is provided a methods for the manufacture of said liquid acidic hard surface cleaning compositions according to the first aspect of the invention.

Certain embodiments of the invention, including certain particularly preferred embodiments of the invention are disclosed in the following examples.

Examples

A number of formulations were produced by mixing the constituents outlined in Table 1 by adding the individual constituents into a beaker of deionized water at room temperature which was stirred with a conventional magnetic stirring rod. Stirring continued until the formulation was homogenous in appearance. It is to be noted that the constituents might be added in any order, but it is preferred that a first premixture is made of any fragrance constituent with one or more surfactants used in the inventive compositions. Thereafter, a major amount of water is first provided to a suitable mixing vessel or apparatus as it is the major constituent and thereafter the further constituents are added thereto convenient. The order of addition is not critical, but good results are obtained where the surfactants (which may be also the premixture of the fragrance and surfactants) are added to the water prior to the remaining constituents.

The exact compositions of the example formulations are listed on Table 1, below, and are identified by one or more digits preceded by the letter "E". Certain comparative compositions are also disclosed on Table 1, and are identified by one or more digits preceded by the letter "C".

TABLE 1

| | C1 | E1 | E2 | E3 |
|---|---|---|---|---|
| sulfamic acid | 5.0 | 5.0 | 5.0 | 5.0 |
| formic acid (85% wt.) | 3.0 | 3.0 | 3.0 | 3.0 |
| LUTENSOL ON60 | — | 1.8 | 1.0 | 1.0 |
| DOWANOL PnP | 0.3 | 0.3 | 0.3 | — |
| ISOPAR G | — | 2.5 | 2.0 | 2.0 |
| colorant | 0.05 | 0.05 | 0.05 | 0.05 |
| fragrance | 0.15 | 0.15 | 0.15 | 0.15 |
| deionized water | q.s. | q.s. | q.s. | q.s. |
| | **C2** | **E4** | **E5** | **E6** |
| sulfamic acid | 5.0 | 5.0 | 5.0 | 5.0 |
| formic acid (85% wt.) | 3.0 | 3.0 | 3.0 | 3.0 |
| NEODOL 91-6 | 0.5 | 0.5 | 0.5 | — |
| LUTENSOL XL-79 | 1.3 | 1.3 | 1.3 | — |
| LUTENSOL ON60 | — | — | — | 1.8 |
| DOWANOL PnP | 0.3 | 0.3 | 0.3 | 0.3 |
| ISOPAR G | — | 2.5 | 2.5 | 2.5 |
| colorant | 0.05 | 0.05 | 0.05 | 0.05 |
| fragrance | 0.15 | 0.15 | 0.15 | 0.15 |
| deionized water | q.s. | q.s. | q.s. | q.s. |

All of the formulations on the foregoing Table 1 are indicated in weight percent, and each composition comprised 100% wt. The individual constituents were used, "as-supplied" from their respective source and unless otherwise indicated, each of the constituents are to be understood as being "100% wt. actives". Deionized water was added in quantum sufficient, "q.s.", to provide the balance to 100% wt. of each of the example compositions. The sources of the constituents used in the formulations of Tables 1 are described on the following Table 2.

TABLE 2

| | |
|---|---|
| sulfamic acid (99.5-100%) | anhydrous sulfamic acid, 99.5-100% wt. actives |
| formic acid (85%) | aqueous solution, formic acid, 94-95% wt. actives |
| NEODOL 91-6 | nonionic surfactant, C9-11 alcohol ethoxylate, 6 moles of ethoxylation (100% wt. actives) |
| LUTENSOL XL 79 (80-90%) | C10-Guerbet alcohol ethoxylate, 7 moles ethoxylation (ex. BASF) (80-90% wt. actives) |
| LUTENSOL ON 60 | C10 oxo-alcohol ethoxylated (ex. BASF) |
| DOWANOL PnP (95%) | propylene glycol n-propyl ether (ex. Dow Chem. Co.), 95% wt. actives |
| ISOPAR G | ISOPAR G described to be primarily a mixture of C10-C11 isoparaffins (ex. ExxonMobil Corp.) |
| fragrance | fragrance composition, proprietary composition of its supplier |
| colorant | aqueous dispersion of a C.I. Acid dye (1% wt. actives) |
| deionized water | deionized water |

Several of the foregoing compositions were tested and evaluated according to one or more of the following test protocols.

Limescale Removal Evaluation:

The efficacy of the compositions in the limescale was demonstrated by the following test.

Several pre-weighed and dried marble cubes (measured in grams) were first prepared by rinsing them with copious amounts of deionized water and subsequently the rinsed marble cubes were placed into a 105° C. oven for at least one hour in order to fully dry. The marble cubes were then removed from the oven, and allowed to cool to room temperature (approx. 20° C.) and each was then individually weighed on an analytical balance. Thereafter, for each tested formulation tested, two marble cube was placed into separate a trays, and 8 ml of a test composition was placed on top of the cube and allowed to remain there for 5 minutes for the first cube, and 10 minutes for the second cube, after which the cubes were then individually rinsed with copious amounts of deionized water and again, after rinsing, each of the cubes was placed into a 105° C. oven for at least one hour in order to fully dry. Subsequently the cubes were allowed to cool to room temperature and reweighed.

The percentage loss of each of the cubes was calculated, and the results are indicated on the following table.

It was visually observed that the composition of the C1 and C2 formulations did not exhibit any visible "Marangoni-type" effect, while the compositions according to E1 through E6 all exhibited visible "Marangoni-type" effects when on the marble cube.

TABLE 3

| | % limescale removed |
|---|---|
| C1 | 0.11082 |
| E1 | 0.138727 |
| E2 | 0.129877 |
| E3 | 0.143282 |
| C2 | 0.25246 |
| E4 | 0.27107 |
| E5 | 0.259835 |
| E6 | 0.302617 |

FIG. 1 illustrates the relative improvement of the compositions according to E1 to E6 as compared to C1, which illustrates the significantly improved efficacy of the cleaning of the compositions according to the invention which in included significant amounts of surfactants and the volatile hydrocarbon, and which optionally further included an amphiphilic solvent constituent. With reference to FIG. 1, the results for E1 through E3 are presented relative to the value for C1, while the results for E4 through E6 are presented relative to the value for C2. This distinction is made due to the differences in the levels of nonionic surfactants present.

It is believed that the improved cleaning efficacy of the compositions according to E1 through E6 are due to the motility of the compositions when placed on the flat top surface of the marble cube used in each test. While not wishing to be bound by the following it is hypothesized that the physical movement of the composition due to the Marangoni-type effect, caused the composition to move between a surface and a soil deposit, "lifting" the latter which both removes the soils off the hard surface, and at the same time supplying a fresh quantity of the composition to the locus of the stain or soil and thus continue its removal from the hard surface.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

The invention claimed is:

1. An acidic hard surface cleaning composition consisting of:

in excess of 1% wt, to 30% wt. of a surfactant system which is at least two different nonionic surfactants, 0.01 to 10% wt. of a volatile paraffinic hydrocarbon having a vapor pressure of 0.2 mmHg or more at 20° C.;

an acid constituent which is one or more organic or inorganic acids in an amount effective to impart an acidic pH to the composition;

an amphiphilic solvent constituent selected from glycol ethers;

at least 85% wt, water, optionally, one or more constituents selected from the group consisting of: coloring agents and fragrances, characterized in that the composition exhibits self-induced movement when the composition is applied as a film or laminar layer onto a hard surface.

2. An acidic hard surface cleaning composition according to claim 1, wherein the acid constituent is at least 2 different acids.

3. An acidic hard surface cleaning composition according to claim 1, wherein the volatile paraffinic hydrocarbon having a vapor pressure of 0.2 mmHg or more at 20° C. is present in an amount from 2 to 10 wt %.

4. An acidic hard surface cleaning composition according to claim 1 wherein the amphiphilic solvent is propylene glycol n-propyl ether.

5. A method of cleaning hard surfaces comprising the step of providing a cleaning effective amount of an acidic hard surface cleaning composition according to claim 1 to the hard surface in need of cleaning.

* * * * *